United States Patent [19]

Holder

[11] 4,087,212

[45] May 2, 1978

[54] TRAVELING OIL PUMP VALVE

[76] Inventor: William D. Holder, 17022 Blackhawk Blvd., Friendswood, Tex. 77546

[21] Appl. No.: 683,172

[22] Filed: May 4, 1976

[51] Int. Cl.[2] ..... F04B 7/00; F04B 21/04

[52] U.S. Cl. ..... 417/444; 417/488; 417/511

[58] Field of Search ..... 417/443–445, 417/456, 457, 469, 488, 510, 511, 512, 513, 514

[56] References Cited

U.S. PATENT DOCUMENTS

| | | | |
|---|---|---|---|
| 1,662,942 | 3/1928 | Snoddy et al. | 417/444 |
| 1,771,690 | 7/1930 | Rankin | 417/445 |
| 1,950,328 | 3/1934 | Scotty et al. | 417/445 |
| 2,131,299 | 9/1938 | Reagin | 417/444 |
| 2,253,926 | 8/1941 | Anderson et al. | 417/511 |
| 2,344,786 | 3/1944 | Patterson et al. | 417/443 |
| 2,690,134 | 9/1954 | Ritchey | 417/443 |
| 2,906,210 | 9/1959 | Mason | 417/511 |

*Primary Examiner*—William L. Freeh
*Attorney, Agent, or Firm*—Bernard A. Reiter

[57] ABSTRACT

A conventional pumping unit is mounted at ground level, to which is attached a hollow sucker rod that extends through a tubing string to the production level of the well. Integral with the tubing string is provided a pump barrel, with communication between the production formation and the tubing string being effected across a ball and seat check valve.

Secured to the lower extremity of the hollow sucker rod is an elongated sleeve-like pump housing having a sealing element at the lower extremity thereof establishing a seal between the pump housing and the pump barrel. Intermediate the extremities of the hollow pump body is formed a plurality of elongated slot-like ports extending parallel with the longitudinal axis of the pump body. An elongated traveling piston is located for reciprocal movement within the pump body and is also provided with a seal at the lower extremity thereof for establishing a sealed relationship with the pump barrel. Ports are formed in the tubular wall structure of the traveling piston to enable pressure induced transfer of well fluid from the pump barrel into the tubing string. The ports of the traveling piston and pump body are capable of registering upon predetermined positioning of the traveling piston relative to the pump body. Such positioning is established upon predetermined movement of the traveling piston relative to the pump body in opposition to the force of a compression spring.

19 Claims, 3 Drawing Figures

TRAVELING OIL PUMP VALVE

FIELD OF THE INVENTION

This invention relates generally to the pumping of fluid from wells such as oil wells, for example, where the fluid medium being pumped typically includes a quantity of gas in solution that is capable of coming out of solution as pressure on the fluid is reduced. More specifically, the present invention concerns the provision of a traveling oil pump valve mechanism that is operated from the surface through its connection with an elongated sucker rod. The pump valve mechanism is effective to achieve pumping of the fluid medium and prevent the development of a gas lock condition that might otherwise occur due to the release of excessive quantities of gas from the fluid medium during the pumping operation.

BACKGROUND OF THE INVENTION

In the pumping of oil wells, virtually all of the well fluid that is pumped includes a quantity of natural gas in solution. For example, the fluid medium pumped may be oil or a mixture of oil and water and will typically include a quantity of gas in solution. During a typical pumping operation, the fluid medium of the well undergoes substantial pressure changes, and these pressure changes tend to allow the gas in solution to become liberated from the liquid constituents of the fluid medium, and the liberated gas may interfere with pumping operations. For example, the fluid medium of a well prior to entering the tubing string or pumping chamber of the well is subjected to a pressure known as the "bottom hole pressure." This bottom hole pressure relates to the inherent pressure of the production formation and to the hydrostatic head of the fluid medium within the well bore. In typical oil wells that require pumping, there is provided a pair of spaced ball seat valves with the pump piston being positioned above the uppermost ball seat valve. As the pump piston moves downwardly, the ball seat valve will become seated, and fluid between the piston and the uppermost ball seat valve will become displaced past the pump piston mechanism. Upon upward movement of the pump piston mechanism, the previously displaced fluid will be moved upwardly for production, and a vacuum condition will be developed within the pumping chamber between the piston and the uppermost ball seat valve. Responsive to this vacuum condition, the ball seat valve will become unseated, and additional fluid medium will flow past the ball seat valve and will enter the pumping chamber, whereupon the pumping cycle may be repeated. As the pump piston moves downwardly, the fluid medium within the pumping chamber is subjected to pressurization for purpose of fluid displacement. As the piston mechanism moves upwardly, however, this fluid medium is subjected to a condition of partial vacuum. Natural gas entrained within the fluid medium tends to become liberated during the partial vacuum condition of the upstroke of the piston. Any natural gas accumulated within the pumping chamber is simply compressed during pumping movement and may interfere with efficient transfer of fluid between the pumping chamber and the tubing. At such time that liquid and gas pressure above the uppermost ball and seat valve of the pumping mechanism equalizes or is greater than the pressure that is developed in the pumping barrel during pumping operations, the piston element will simply cycle in its normal manner, but fluid transfer will not occur because the piston movement merely causes compression and expansion of the gas within the pumping chamber. This condition is known as "gas-lock" in the industry and is, of course, the subject of much concern to the industry from the standpoint of losses in production.

Where the pumping mechanism of the well includes a stationary valve mechanism having a ball and seat with a traveling valve mechanism also having a ball and seat that is movable relative to the stationary valve mechanism. The variable volume between the ball and seat mechanisms of the stationary and traveling valve devices constitutes the pumping chamber. A condition of gas-lock will occur when an excessive amount of gas collects within the pumping chamber and the pressure developed by the hydrostatic head of liquid above the ball and seat mechanism of the traveling valve is equal to or greater than the pressure of the compressed gas within the pumping chamber in the compression stroke, and when the pressure within the pumping chamber during the vacuum stroke is equal to the bottom hole pressure of the well. It is of course very desirable to provide a traveling oil pump valve mechanism that is capable of efficiently lifting well fluid, including oil, to the surface for production and which is also effective to prevent the development of a gas-lock condition during pumping. Accordingly, it is a primary feature of the present invention to provide a novel traveling oil pump valve mechanism that serves as the traveling valve mechanism of a spaced valve pumping system and which automatically provides for venting liberated gas into the tubing string for production along with the liquid medium that is pumped from the well.

It is also an important feature of the present invention to provide a novel traveling oil pump valve mechanism incorporating very few parts that are exposed to wear during pumping operations, thereby promoting the effective service life of the pumping mechanism.

Among the several features of the present invention is noted the contemplation of a novel traveling oil pump valve mechanism that is very simply assembled and disassembled and may be repaired quite easily and inexpensively.

It is also a feature of the present invention to provide a novel traveling oil pump valve mechanism that is of simple nature, is low in cost and reliable in use.

Other and further features of the present invention will become apparent to one skilled in the art upon an understanding of the invention presented in the drawings, in which.

DESCRIPTION OF THE PREFERRED EMBODIMENTS

Figure 1:
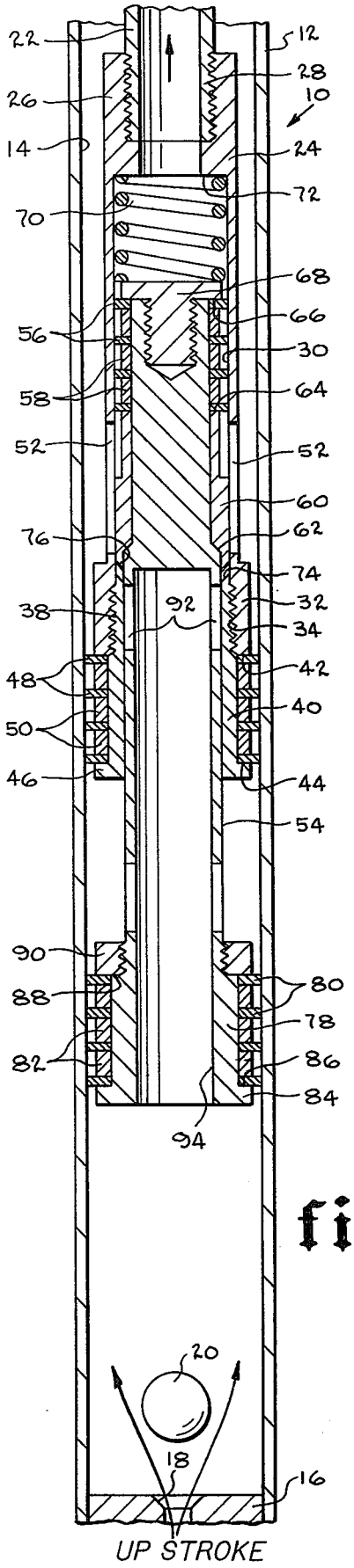
FIG. 1 is a sectional view of a traveling oil pump valve mechanism constructed in accordance with the present invention and showing the valve mechanism in the up-stroke position thereof.
Figure 2:
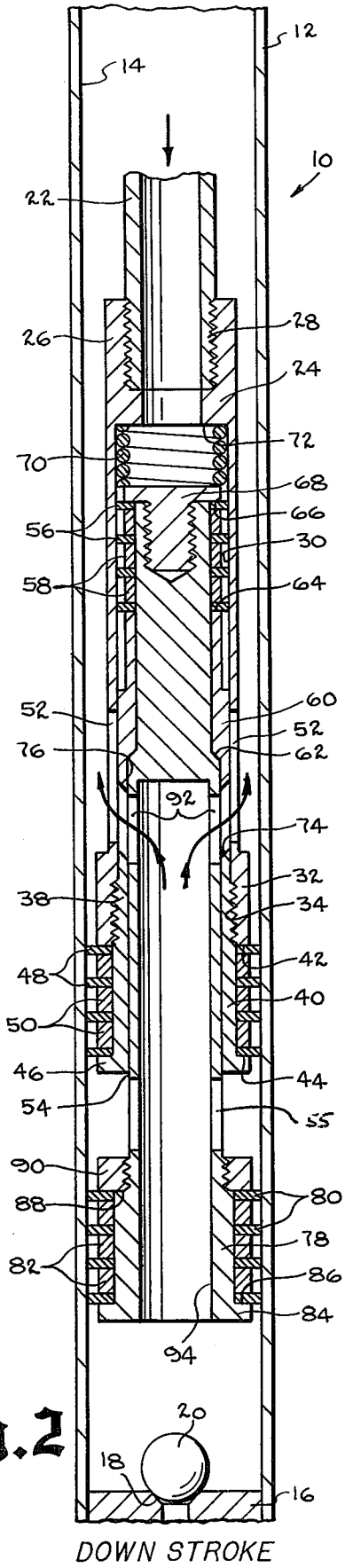
FIG. 2 is a sectional view of the traveling oil pump valve mechanism of FIG. 1 illustrating the pump valve mechanism in the down-stroke position thereof.

Referring now to the drawings and first to FIG. 1, there is provided a traveling oil pump valve mechanism illustrated generally at 10 that includes a pump barrel 12 having a finely machined or polished inner cylindrical surface 14. At the lower extremity of the pump barrel 12 may be provided a valve seat structure 16 having a seat surface 18 formed therein that is capable of receiving a ball check valve 20 to provide a seal. As shown in FIG. 1, the ball check element 20 is shown to be lifted from the seat 18 under the influence of fluid flowing upwardly, as shown by the flow arrows, during the upstroke or vacuum stroke of the pumping valve mechanism. As shown in FIG. 2, the ball check valve 20 is shown to be seated against seat surface 18 during the down-stroke or compression stroke of the valve mechanism. The ball check valve mechanism illustrated at the lower extremity of the pump barrel may be of the same type that is conventionally employed in traveling pump valve mechanisms.

In general, a conventional pumping unit is mounted at ground level, to which may be attached a hollow sucker rod, the lower extremity of which is shown at 22. The sucker rod reciprocates within the barrel structure 12 and within the tubing structure to which the barrel is connected. A traveling piston housing 24 may be located within the pumping barrel and may be formed to define an internally threaded upper extremity 26 that receives the externally threaded lower extremity 28 of the hollow sucker rod 22. The traveling piston housing 24 is of elongated tubular configuration defining an internal cylindrical surface 30 and terminating at an enlarged annular portion 32 adjacent the lower extremity thereof. The enlarged annular shoulder portion 32 may be internally threaded, as shown at 34, for the purpose of receiving the externally threaded portion 38 of a seal retainer sleeve 40. Annular shoulders 42 and 44 defined respectively by the enlarged annular shoulder portion 32 and a lower flange 46 defined at the lower extremity of the seal retainer sleeve 40 retain a plurality of seal rings 48 and seal ring spacers 50 in proper position for the establishment of a sealed relationship between the traveling piston housing and the internal cylindrical surface 14 of the barrel 12. The annular seal rings 48 may be composed of any suitable wear-resistant sealing material.

The travel piston housing 24 is also formed to define a plurality of ports 52 in the wall structure thereof. Ports 52 are typically formed by a plurality of elongated slots extending in generally parallel relation with the longitudinal axis of the sleeve. Any suitable number of ports may be provided, as desired.

A traveling piston illustrated generally at 54 may extend at least partially within the hollow tubular portion of the traveling piston housing 24 and may be freely movable within defined limits between open and closed positions responsive to the pressure conditions that are developed during pumping operation. The internal portion of the traveling piston mechanism 54 may be of generally cylindrical external configuration and may receive a plurality of seal rings 56 and spacer rings 58, with the seal rings establishing sealing contact with the internal cylindrical surface 30 of the traveling piston housing. A piston valve sealing element 60 that also functions as a piston seal retainer seats against a tapered external shoulder surface 62 defined on the traveling piston element 54 to limit movement of the piston valve seal element in one direction relative to the traveling piston. The annular seal rings 56 and retainer rings 58 may be contained between annular shoulders 64 and 66 defined respectively on the piston valve seal element 60 and a hold-down bolt 68 that is threadedly received within an internally threaded aperture formed in the upper extremity of the traveling piston. An annular compression spring element 70 may be interposed between the hold-down bolt 68 and an annular shoulder 72, allowing the compression spring to impart a mechanical force to the traveling piston 54, urging the traveling piston downwardly as shown in the drawings.

The seal retainer sleeve element 40 is shown to be provided with an internally tapered annular seat surface 74 that, in the closed position of the valve mechanism, has seating engagement with the externally tapered seat surface 76 defined at the lower extremity of the piston valve sealing element 60. During the vacuum or intake stroke of the pump valve mechanism, tapered seat surfaces 74 and 76 will be in fluid-blocking contact, as shown in FIG. 1.

The external portion of the traveling piston element 54 may be formed to define an annular enlargement 78 that is adapted to receive a plurality of annular seal rings and spacer rings 80 and 82, respectively. A flange structure 84 defined at the lower extremity of the traveling piston element 54 defines an annular shoulder 86 that cooperates with an annular shoulder 88 defined on an annular retainer ring 90 to retain the sealing rings and spacer rings in properly retained relationship relative to the annular enlarged portion 78. The retainer ring 90 may be secured in place relative to the traveling piston structure by threaded engagement, as shown, or by any other suitable form of connection.

The traveling piston element 54 may also be formed to define a plurality of ports 92 in the wall structure thereof that may be formed by elongated slots that extend substantially parallel to the longitudinal axis of the traveling piston structure. The ports 92 will become registered with the ports 52 of the traveling piston housing upon movement of the pump valve mechanism to the FIG. 2 position thereof. During such movement, the piston valve seal element separates from its sealing relationship with the internally tapered surface 74 of the seal retainer sleeve 40, thereby allowing transfer of fluid and gas from the pumping chamber of the valve mechanism into the tubing string. Piston 54 includes port 55 to allow oil to move freely, precluding vacuum or pressure between piston and housing.

OPERATION

With reference now to FIG. 1, the valve mechanism shown is in the up-stroke or intake stroke, with the hollow sucker rod being moved upwardly by the hollow sucker rod string. The outer surface of the hollow sucker rod immediately above the valve mechanism may be polished, allowing it to move through a suitable rod guide structure that is retained within the pump barrel of the pump valve mechanism. As the traveling piston housing is moved upwardly by the hollow sucker rod, the sealing rings 48 will maintain the sealed relationship thereof with the cylindrical internal surface 14 of the pump barrel, thereby causing any liquid medium contained therein to be moved upwardly within the tubing string for production thereof. Friction between the annular seal rings 80 at the lower extremity of the traveling piston during upward movement thereof, together with the force induced by the compression springs 70, will cause the traveling piston 54 to be urged downwardly, bringing the tapered seat surfaces 74 and 76 into intimate sealing engagement and preventing backflow of fluid through the valve mechanism. Simultaneously with the up-stroke of the pump mechanism, a partial vacuum condition will be developed within the pumping chamber P, and the ball check element 20 will be lifted from its seat 18 by inflowing fluid medium.

Upon completion of the up-stroke of the pump valve mechanism, the direction of the sucker rod 22 will be reversed and the pump valve mechanism will be forced downwardly within the barrel 12. When this occurs, the seal between the pump barrel and the annular seal rings 48 of the traveling piston housing will be maintained, and the sealed relationship between seal rings 80 and the pump barrel will also be maintained. As the traveling piston housing moves downwardly, the traveling piston encounters the resistance of the fluid medium entrapped within the pump chamber P, and the pump check valve 20 will again be seated against seat 18, preventing backflow of the fluid medium from the pumping chamber. Due to the resistance encountered by the traveling piston 54, the traveling piston, while moving downwardly, will also move upwardly relative to the traveling piston housing. In other words, the traveling piston is forced by the resistance of the fluid medium into the traveling piston housing in opposition to the force developed by the compression spring 70. Such movement causes the piston valve seal to move upwardly relative to the seal retainer sleeve 40, thereby providing an annular flow opening through which the fluid may flow, in the manner shown by flow arrows in FIG. 2. Upward movement of the traveling piston relative to the traveling piston housing also causes the ports 92 of the traveling piston to become registered with the ports 52 of the piston housing, such as is also shown in FIG. 2. Under this condition, downward movement of the traveling piston housing and traveling piston causes fluid to be displaced from the pumping chamber through the internal passage 94 of the traveling piston to be displaced through the registering ports 52 and 92. The fluid then flows into the annulus between the traveling piston housing and the pump barrel. Following termination of the down-stroke shown in FIG. 2, the traveling piston housing is again moved upwardly within the pump barrel. Initial movement reduces the pressure acting against the traveling piston 54 and allows the compression spring 70 to urge the traveling piston downwardly relative to the traveling piston housing, thereby causing the tapered seat surfaces of the seal retainer sleeve and piston valve seal to again move into intimate sealing engagement.

Any gas that becomes liberated from the produced liquid, especially during the up-stroke which produces a partial vacuum condition within the pumping chamber, will readily flow through the registering ports during the downward pumping stroke of the valve mechanism. There will be little tendency for any accumulation of gas within the pumping chamber, and therefore the pumping condition of the valve mechanism will remain efficient at all times.

Figure 3:
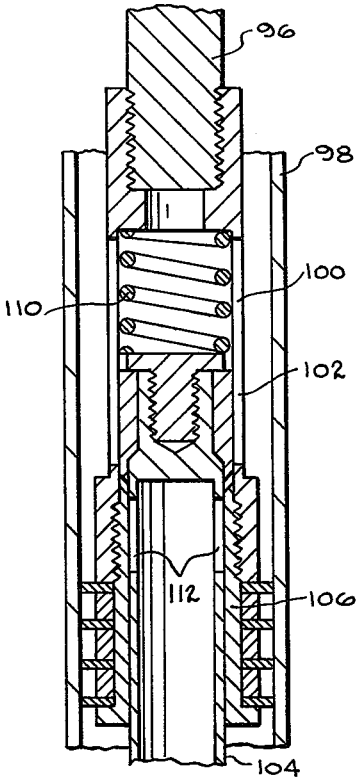
FIG. 3 is a fragmentary sectional view of a traveling oil pump valve mechanism representing a modified form of the present invention.

Referring now to FIG. 3, there is shown an alternative embodiment of the present invention which differs from the travel oil pump valve mechanism shown in FIGS. 1 and 2 only in the provision for venting the spring chamber that is developed between the traveling piston housing and the upper extremity of the traveling piston. The structure illustrated in FIG. 3 promotes utilization of a solid sucker rod such as shown at 96, which also may be formed immediately adjacent the pump valve mechanism to enable the sucker rod to be received by a sucker rod guide contained within the pump barrel 98. In this case, a traveling piston housing 100 may be provided having its wall structure formed to define a plurality of vent ports 102. The vent ports are sufficiently elongated so as to vent the volumetric area of the spring chamber and also to provide for effective fluid transfer when the traveling piston 104 is moved upwardly relative to the traveling piston housing. Here again, the seal retainer sleeve 106 that is provided defines an internally tapered seal surface that is engaged by the externally tapered annular seal surface of the piston valve seal 108 in the closed position of the valve mechanism that occurs during the up-stroke. As the traveling piston moves upwardly relative to the traveling piston housing responsive to the development of pressure within the pumping chamber P, such as shown in FIG. 2, the compression spring 110 will be compressed and the ports 112 of the traveling piston will become registered with the ports 102 of the traveling piston housing.

In contrast, however, venting of the traveling oil pump valve mechanism shown in FIGS. 1 and 2 occurs by way of the vent passage defined by the hollow sucker rod 22. Any gas or fluid contained within the variable volume spring chamber upwardly of the piston seal elements 56 will be vented upwardly, as shown by the vent flow arrow, through the bore of the hollow sucker rod.

The traveling oil pump valve mechanism of the present invention will function efficiently to pump liquid from wells over long periods of time and will not have any tendency whatever to become gas-locked.

Having thus explained my invention in detail, I claim:

1. A traveling fluid pump valve mechanism for pumping of fluid from deep wells such as oil wells, said pump valve mechanism comprising:

pump barrel means;

check valve means provided within said pump barrel means and allowing unidirectional flow of fluid medium into said pump barrel means;

first piston means located within said pump barrel means and being reciprocated by sucker rod means operatively connected to sucker rod actuating means, said first piston means having sealed engagement with said pump barrel means and cooperating with said pump barrel means and said check valve means to define a pumping chamber, said first piston means being formed to define first port means;

second piston means being movably supported by said first piston means and having second seal means provided thereon for establishing movable sealed relation with said pump barrel means, said second piston means being formed to define second port means;

piston valve seal means being interposed between said first and second piston means and being movable between an open position allowing fluid communication between said first and second port means and a closed position blocking fluid communication between said first and second port means;

means urging said piston valve seal means toward said closed position thereof; and said second piston means being movable relative to said first piston means, and in opposition to said means urging said piston valve seal means toward said closed position, responsive to the development of a predetermined pressure condition within said pumping chamber to cause opening movement of said piston valve seal means to place said first and second port means in fluid communicating registry.

2. A traveling fluid pump valve mechanism as recited in claim 1, wherein said second piston means includes:

third seal means establishing movable sealed relation with said first piston means; and vent means allowing interchange of fluid medium between said first and second piston means to compensate for relative movement therebetween.

3. A traveling fluid pump valve mechanism as recited in claim 1, wherein:

said first port means in said first piston means is defined by a plurality of elongated slots formed in said first piston means; and said second port means in said second piston means is defined by a plurality of elongated slots formed in said second piston means, said first and second port means being positioned in registering relation upon predetermined movement of said second piston means relative to said first piston means.

4. A traveling fluid pump valve mechanism as recited in claim 1, wherein:

said first piston means is of at least partially tubular configuration;

said second piston means is received at least partially within said first piston means and cooperates with said first piston means to define spring chamber means;

said urging means is spring means located within said spring chamber means; and vent means is defined by said pump valve mechanism allowing interchange of fluid medium from said spring chamber means to compensate for movement of said second piston means within said first piston means.

5. A traveling fluid pump valve mechanism as recited in claim 4, wherein:

said vent means is defined by vent passage means formed within said sucker rod means and communicating with said spring chamber means.

6. A traveling fluid pump valve mechanism as recited in claim 4, wherein:

said vent means is defined by said first port means.

7. A traveling fluid pump valve mechanism as recited in claim 1, wherein:

said first piston means defines first seat means; and said piston valve seal means defines second seat means intimately engaging said first seat means in said closed position of said piston valve seal means to block fluid transfer of fluid from said pumping chamber means.

8. A traveling fluid pump valve mechanism as recited in claim 7, wherein:

said piston valve seal means is supported by said second piston means and is movable along with said second piston means.

9. A traveling fluid pump valve mechanism for pumping fluid from deep wells such as oil wells, said pump valve mechanism comprising:

pump barrel means having a check valve allowing unidirectional flow of fluid medium into said pump barrel;

traveling valve housing means being movably located within said pump barrel and being reciprocated by sucker rod means connected to sucker rod actuating means located at the well surface, said traveling valve housing means having movable sealed relation with said pump barrel means, said traveling valve housing means defining first port means;

traveling piston means being movably disposed within said pump barrel means and having movable sealed relation with said pump barrel means and said traveling valve housing means, said traveling piston means defining second port means, said traveling valve housing and traveling piston cooperating with said pump barrel means and said check valve to define a pumping chamber; and valve means being located within said pump barrel means and being movable between an open position allowing fluid communication between said first and second port means and a closed position blocking fluid communication between said first and second port means, said valve means being movable to said open position responsive to the development of a predetermined pressure condition within said pumping chamber, and biasing means operably associated with said first and second port means for urging the said port means into closed position in opposition to the fluid pressure.

10. A traveling fluid pump valve mechanism as recited in claim 9, wherein said traveling piston means establishes sealed relation with said traveling valve housing at spaced locations and said first port means is located intermediate said spaced locations.

11. A traveling fluid pump valve mechanism as recited in claim 9, wherein said traveling piston means includes:

vent seal means establishing movable sealed relation with said first piston means; and vent means allowing interchange of fluid medium between said first and second piston means to compensate for relative movement therebetween.

12. A traveling fluid pump valve mechanism as recited in claim 9, wherein:

said first piston means defines first seat means; and said piston valve seal means defines second seat means intimately engaging said first seat means in said closed position of said piston valve seal means to block fluid transfer of fluid from said pumping chamber means.

13. A traveling fluid pump valve mechanism as recited in claim 12, wherein:

said piston valve seal means is supported by said traveling piston means and is movable along with said traveling piston means.

14. A traveling fluid pump valve mechanism for pumping fluid from deep wells such as oil wells, such pump valve mechanism comprising:

pump barrel means having a check valve allowing unidirectional flow of fluid medium into said pump barrel;

traveling valve housing means being movably located within said pump barrel and being reciprocated by sucker rod means connected to sucker rod actuating means located at the well surface, said traveling valve housing means having movable sealed relation with said pump barrel means, said traveling valve housing means defining first port means;

traveling piston means being movably disposed within said pump barrel means and having movable sealed relation with said pump barrel means and said traveling valve housing means, said traveling piston means defining second port means, said traveling valve housing and traveling piston cooperating with said pump barrel means and said check valve to define a pumping chamber; and valve means located within said pump barrel means and being movable between an open position allowing fluid communication between said first and second port means and a closed position blocking fluid communication between said first and second port means, said valve means being movable to said open position responsive to the development of a predetermined pressure condition within said pumping chamber urging means interposed between said traveling valve housing and said traveling piston means and urging said valve means toward said closed position thereof.

15. A traveling fluid pump valve mechanism as recited in claim 14, wherein:

said valve means is supported by said traveling piston means and is movable along with said traveling piston means; and said urging means imparts a force directly to said traveling piston means and indirectly to said valve means.

16. A traveling fluid pump valve mechanism for pumping fluid from deep wells such as oil wells, said pump valve mechanism comprising:

pump barrel means having a check valve allowing unidirectional flow of fluid medium into said pump barrel;

traveling valve housing means being movably located within said pump barrel and being reciprocated by sucker rod means connected to sucker rod actuating means located at the well surface, said traveling valve housing means having movable sealed relation with said pump barrel means, said traveling valve housing means defining first port means;

traveling piston means being movably disposed within said pump barrel means and having movable sealed relation with said pump barrel means and said traveling valve housing means, said traveling piston means defining second port means, said traveling valve housing and traveling piston cooperating with said pump barrel means and said check valve to define a pumping chamber; and valve means being located within said pump barrel means and being movable between an open position allowing fluid communication between said first and second port means and a closed position blocking fluid communication between said first and second port means, said valve means being movable to said open position responsive to the development of a predetermined pressure condition within said pumping chamber, said traveling valve housing means is of at least partially tubular configuration;

said traveling piston means is received at least partially within said traveling valve housing means and cooperates with said traveling valve housing means to define spring chamber means;

spring means located within said spring chamber means and imparting a force to said traveling piston means and said traveling valve housing means urging said traveling piston means in one direction; and vent means is defined by said pump valve mechanism allowing interchange of fluid medium from said spring chamber means to compensate for movement of said traveling piston means within said traveling valve housing means.

17. A traveling fluid pump valve mechanism as recited in claim 16, wherein:

said vent means is defined by vent passage means formed within said sucker rod means and communicating with said spring chamber means.

18. A traveling fluid pump valve mechanism as recited in claim 16, wherein:

said vent means is defined by said first port means.

19. A traveling fluid pump valve mechanism for pumping fluid from deep wells such as oil wells, said pump valve mechanism comprising:

pump barrel means having a check valve allowing unidirectional flow of fluid medium into said pump barrel;

traveling valve housing means being movably located within said pump barrel and being reciprocated by sucker rod means connected to sucker rod actuating means located at the well surface, and traveling valve housing means having movable sealed relation with said pump barrel means, said traveling valve housing means defining first port means;

traveling piston means being movably disposed within said pump barrel means and having movable sealed relation with said pump barrel means and said traveling valve housing means, said traveling piston means defining second port means, said traveling valve housing and traveling piston cooperating with said pump barrel means and said check valve to define a pumping chamber; and valve means being located within said pump barrel means and being movable between an open position allowing fluid communication between said first and second port means and a closed position blocking fluid communication between said first and second port means, said valve means being movable to said open position responsive to the development of a predetermined pressure condition within said pumping chamber, said first port means in said traveling valve housing means is defined by a plurality of elongated slots formed in said traveling valve housing means; and said second port means in said traveling piston means is defined by a plurality of elongated slots formed in said traveling piston means, said first and second port means being positioned in registering relation upon predetermined movement of said traveling piston means relative to said traveling valve housing means.

* * * * *